US008425699B2

(12) United States Patent
Mori et al.

(10) Patent No.: US 8,425,699 B2
(45) Date of Patent: Apr. 23, 2013

(54) SWASH PLATE TYPE PISTON PUMP MOTOR AND METHOD FOR MANUFACTURING THE SAME

(75) Inventors: Takashi Mori, Kobe (JP); Yasuo Ohmi, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 539 days.

(21) Appl. No.: 12/593,595

(22) PCT Filed: Jan. 22, 2008

(86) PCT No.: PCT/JP2008/050765
§ 371 (c)(1),
(2), (4) Date: Oct. 6, 2009

(87) PCT Pub. No.: WO2008/120483
PCT Pub. Date: Oct. 9, 2008

(65) Prior Publication Data

US 2010/0107865 A1 May 6, 2010

(30) Foreign Application Priority Data

Mar. 29, 2007 (JP) ..... 2007-086284

(51) Int. Cl.
*C21D 1/00* (2006.01)
*C21D 1/09* (2006.01)

(52) U.S. Cl.
USPC ..... 148/565; 148/525; 148/639; 148/903

(58) Field of Classification Search ..... 148/500–512, 148/516–537, 565, 639; *C21D 1/09*
See application file for complete search history.

(56) References Cited

FOREIGN PATENT DOCUMENTS

| | | | |
|---|---|---|---|
| JP | 59-231179 | | 12/1984 |
| JP | 60-149727 | | 8/1985 |
| JP | 61218822 | A | 9/1986 |
| JP | 62-133016 | | 6/1987 |
| JP | 63034370 | A | 2/1988 |
| JP | 2170885 | A | 7/1990 |
| JP | 7256445 | A | 10/1995 |
| JP | 10082430 | A | 3/1998 |
| JP | 10-176216 | * | 6/1998 |

(Continued)

OTHER PUBLICATIONS

ISA Japanese Patent Office, Search Report of PCT/JP2008/050765, Feb. 26, 2008, Japan, 2 pages.

*Primary Examiner* — Scott Kastler
*Assistant Examiner* — Vanessa Luk
(74) *Attorney, Agent, or Firm* — Alleman Hall McCoy Russell & Tuttle LLP

(57) ABSTRACT

The present invention provides a method for manufacturing a swash plate type piston pump motor in which: a plurality of pistons are arranged in a circumferential direction on a cylinder block configured to rotate with a rotating shaft; the pistons are guided along a swash plate to reciprocate by rotation of the rotating shaft; a convex portion of the swash plate is slidably supported by a recess of a swash plate support; and a wall formed integrally with the swash plate support is arranged on a normal to at least a part of a supporting surface of the recess, wherein: the supporting surface of the recess is quenched by irradiating the supporting surface with laser light while causing the laser light to scan the supporting surface; and outputs of the laser light are changed in accordance with incidence angles of the laser light with respect to the supporting surface.

5 Claims, 11 Drawing Sheets

FOREIGN PATENT DOCUMENTS

| | | | |
|---|---|---|---|
| JP | 11-050951 | * | 2/1999 |
| JP | 2005213553 A | | 8/2005 |
| JP | 2006-183627 | * | 7/2006 |
| JP | 2006-266139 | * | 10/2006 |
| JP | 2006307725 A | | 11/2006 |
| JP | 2007-092707 | * | 4/2007 |
| WO | 2008/120483 | | 10/2008 |

* cited by examiner

SWASH PLATE TYPE PISTON PUMP MOTOR AND METHOD FOR MANUFACTURING THE SAME

TECHNICAL FIELD

The present invention relates to a swash plate type piston pump motor in which a swash plate is supported by a swash plate support so as to be able to tilt with respect to a rotating shaft, and a method for manufacturing the swash plate type piston pump motor.

BACKGROUND ART

In a general swash plate type piston pump, a rotating shaft and a fixed cylinder block are provided in a casing of the swash plate type piston pump, and front end portions of a plurality of pistons extending substantially in parallel with the rotating shaft are inserted into the cylinder block (see Japanese Laid-Open Patent Application Publication 11-50951 for example). Rear end portions of the pistons are introduced to a front surface of a swash plate inclined with respect to the rotating shaft. The pistons reciprocate by the rotation of the cylinder block to suck/discharge hydraulic oil. A circular- convex portion is formed on a rear surface of the swash plate, and is supported by a circular- recess of a swash plate support. Then, lubricating oil is supplied to a supporting surface of the swash plate support, and the swash plate is caused to tilt with respect to the rotating shaft. Thus, the stroke of the piston changes to adjust the amount of hydraulic oil discharged. At this time, the increase in a tilt angle of the swash plate increases the stroke of the piston, thereby increasing the amount of hydraulic oil discharged, whereas the decrease in the tilt angle of the swash plate decreases the stroke of the piston, thereby decreasing the amount of hydraulic oil discharged.

In the foregoing swash plate type piston pump, since a reaction force applied by the hydraulic oil to the pistons when the pistons move back into the cylinder block to discharge the hydraulic oil acts on the swash plate, a surface pressure between the swash plate and the swash plate support becomes very high. Therefore, a lubricating oil film at an interface between the swash plate and the swash plate support tends to run out. On this account, friction surfaces of the swash plate and the swash plate support require seizing resistance and abrasion resistance. Conventionally, the seizing resistance and the abrasion resistance are given to the swash plate support, made of cast iron, by carrying out a surface hardening heat treatment, such as a gas nitrocarburizing, with respect to the swash plate support. Moreover, in the case of a comparatively large pump, the seizing resistance and the abrasion resistance may be given to the swash plate support by carrying out a copper alloy lining with respect to the supporting surface of the swash plate support.

In a piston pump, a rotational power transferred to the rotating shaft is an input, and the hydraulic oil discharged by the piston is an output. In contrast, in a piston motor, the inflow of pressure oil is an input, and the rotational power of the rotating shaft is an output. To be specific, although how to use the piston pump and how to use the piston motor are different from each other, the piston pump and the piston motor are basically the same as each other in configuration. Therefore, such configuration is referred to as a piston pump motor in the present description.

DISCLOSURE OF THE INVENTION

Problems to be Solved by the Invention

A surface treatment may be carried out with respect to only the friction surface in the case of carrying out the gas nitrocarburizing for causing nitrogen to diffusively intrude into the friction surface to harden the friction surface. However, because of the treatment efficiency, there is no choice but to carry out the gas nitrocarburizing with respect to the whole parts, so that large-scale equipment is required for mass production. Moreover, since the whole parts are heated at high temperature (about 500 to 600° C.) in the gas nitrocarburizing, they need to be subjected to annealing for stress relief before the gas nitrocarburizing to prevent heat deformation. In addition, since the gas nitrocarburizing becomes unstable if the surfaces of the parts are not cleaned, a pretreatment of cleaning the parts is required, so that a number of operation steps increases. Further, since a plurality of parts is subjected to batch processing at one time in the gas nitrocarburizing in consideration of work efficiency, a production lead time may become long.

Meanwhile, in the case of carrying out the copper alloy lining with respect to the supporting surface of the swash plate support, furnace brazing, build up welding, mechanical joint, or the like is used as a method for fixing a separate copper alloy plate on the supporting surface of the swash plate support. However, in the case of carrying out the furnace brazing, the same problems occur as when carrying out the gas nitrocarburizing, i.e., large-scale equipment is required, the number of operation steps increases, and the production lead time becomes long. In the case of carrying out the build up welding, the problems are that the build up welding requires skill, and the quality varies. In the case of carrying out the mechanical joint using a bolt, or the like, the problem is that a gap between the swash plate support and the copper alloy plate is formed at a position far from a position where the bolt is used, and this causes, for example, the leakage of oil.

Here, an object of the present invention is to provide a method for giving the seizing resistance and the abrasion resistance to the swash plate support while improving the productivity and the quality.

Means for Solving the Problems

The present invention was made in view of the above-described circumstances, and a first method for manufacturing a swash plate type piston pump motor according to the present invention is a method for manufacturing a swash plate type piston pump motor in which: a plurality of pistons are arranged in a circumferential direction on a cylinder block configured to rotate with a rotating shaft; the pistons are guided along a swash plate to reciprocate by rotation of the rotating shaft; a convex portion of the swash plate is slidably supported by a recess of a swash plate support; and a wall formed integrally with the swash plate support is arranged on a normal to at least a part of a supporting surface of the recess, wherein: the supporting surface of the recess of the swash plate support is quenched by irradiating the supporting surface with laser light while causing the laser light to scan the supporting surface; and an output of the laser light is changed in accordance with an incidence angle of the laser light with respect to the supporting surface.

With this, only the supporting surface of the swash plate support may be quenched by the laser light. Therefore, the seizing resistance and the abrasion resistance can be cleanly given to the supporting surface by small-scale equipment in a short period of time. Further, since this quenching is selective quenching whose case depth is shallow, the heat deformation is less likely to occur, so that finishing processing can be omitted. Moreover, the laser quenching can be carried out in the atmosphere, and does not require cooling fluid. Further, a quenched surface only has to have a certain absorption ratio of the laser light. Therefore, a high-quality surface treatment can be realized without paying too much attention to cleanliness of surfaces of parts as in the case of the gas nitrocarburizing. On this account, inline processing can be carried out in a production line of the piston pump motor. Thus, the seizing resistance and abrasion resistance of the supporting surface of the swash plate support can be increased while improving the productivity and the quality.

Further, the wall formed integrally with the swash plate support is arranged on the normal to at least a part of the supporting surface, so that there is a portion of the supporting surface which portion cannot be irradiated with the laser light at a right angle (incidence angle=90 degrees). However, by suitably changing the output of the laser light in accordance with the incidence angle of the laser light, such as by increasing the output of the laser light when the incidence angle of the laser light becomes small, the amount of laser light absorbed by the supporting surface can be adjusted, and the change in the quenching depth with respect to the supporting surface can be controlled. Therefore, the quenching depth can be suitably adjusted such that the seizing resistance and the abrasion resistance are surely given to the entire supporting surface.

In the first method for manufacturing the swash plate type piston pump motor, the supporting surface may be formed in a circular- shape which curves along a tilt direction of the swash plate; the wall may be arranged on a normal to each of both end portions of the supporting surface with respect to the tilt direction, and an opening may be formed on a normal to a center portion of the supporting surface with respect to the tilt direction; the incidence angle of the laser light with respect to each of the end portions of the supporting surface may be smaller than the incidence angle of the laser light with respect to the center portion of the supporting surface; and an output of the laser light with respect to each of the end portions of the supporting surface may be higher than an output of the laser light with respect to the center portion of the supporting surface.

In this case, the center portion of the circular- supporting surface can be irradiated with the laser light through the opening at a right angle. In contrast, each of the end portions of the circular- supporting surface cannot be irradiated with the laser light at a right angle since the wall interrupts the laser light. Therefore, the incidence angle of the laser light has to be reduced. Generally, if the incidence angle becomes small, a reflection component increases, so that an absorption component of the laser light on the supporting surface decreases. However, in accordance with the above method, since the output of the laser light with respect to each of the end portions of the supporting surface is adjusted to be higher than the output of the laser light with respect to the center portion of the supporting surface, the amount of laser light absorbed by the supporting surface can be uniformized along the tilt direction. Therefore, the seizing resistance and the abrasion resistance can be uniformly given to the entire supporting surface.

A second method for manufacturing a swash plate type piston pump motor according to the present invention is a method for manufacturing a swash plate type piston pump motor in which: a plurality of pistons are arranged in a circumferential direction on a cylinder block configured to rotate with a rotating shaft; the pistons are guided along a swash plate to reciprocate by rotation of the rotating shaft; a circular- convex portion of the swash plate is slidably supported by a circular- recess of a swash plate support; and a wall formed integrally with the swash plate support is arranged on a normal to at least a part of a supporting surface of the recess, wherein: the supporting surface of the recess of the swash plate support is quenched by causing laser light to scan the supporting surface; and a scan speed of the laser light is changed in accordance with an incidence angle of the laser light with respect to the supporting surface.

With this, only the supporting surface of the swash plate support may be quenched by the laser light. Therefore, the seizing resistance and the abrasion resistance can be cleanly given to the supporting surface by small-scale equipment in a short period of time. Further, since this quenching is selective quenching whose case depth is shallow, the heat deformation is less likely to occur, so that finishing processing can be omitted. Moreover, the laser quenching can be carried out in the atmosphere, and does not require cooling fluid. Further, a quenched surface only has to have a certain absorption ratio of the laser light. Therefore, a high-quality surface treatment can be realized without paying too much attention to cleanliness of surfaces of parts as in the case of the gas nitrocarburizing. On this account, inline processing can be carried out in a production line of the piston pump motor. Thus, the seizing resistance and abrasion resistance of the supporting surface of the swash plate support can be increased while improving the productivity and the quality.

Further, the wall formed integrally with the swash plate support is arranged on the normal to at least a part of the supporting surface, so that there is a portion of the supporting surface which portion cannot be irradiated with the laser light at a right angle (incidence angle=90 degrees). However, by suitably changing the scan speed of the laser light in accordance with the incidence angle of the laser light, such as by reducing the scan speed of the laser light to increase the amount of irradiation of laser light when the incidence angle of the laser light becomes small, the amount of laser light absorbed by the supporting surface can be adjusted, and the change in the quenching depth with respect to the supporting surface can be controlled. Therefore, the quenching depth can be suitably adjusted such that the seizing resistance and the abrasion resistance are surely given to the entire supporting surface.

In the second method for manufacturing the swash plate type piston pump motor, the supporting surface may be formed in a circular- shape which curves along a tilt direction of the swash plate; the wall may be arranged on a normal to each of both end portions of the supporting surface with respect to the tilt direction, and an opening may be formed on a normal to a center portion of the supporting surface with respect to the tilt direction; the incidence angle of the laser light with respect to each of the end portions of the supporting surface may be smaller than the incidence angle of the laser light with respect to the center portion of the supporting surface; and a scan speed of the laser light with respect to each of the end portions of the supporting surface may be lower than a scan speed of the laser light with respect to the center portion of the supporting surface.

In this case, the center portion of the circular- supporting surface can be irradiated with the laser light through the opening at a right angle. In contrast, each of the end portions of the circular- supporting surface cannot be irradiated with the laser light at a right angle since the wall interrupts the laser light. Therefore, the incidence angle of the laser light has to be reduced. Generally, if the incidence angle becomes small, a reflection component increases, so that an absorption component of the laser light on the supporting surface decreases. However, in accordance with the above method, since the scan speed of the laser light with respect to each of the end portions of the supporting surface is adjusted to be lower than the scan speed of the laser light with respect to the center portion of the supporting surface, the amount of irradiation of laser light increases, and the amount of laser light absorbed by the supporting surface can be uniformized along the tilt direction. Therefore, the seizing resistance and the abrasion resistance can be uniformly given to the entire supporting surface.

The swash plate support may be formed integrally with a casing, and the wall may be the casing. With this, since the swash plate support and the casing are integrally formed, the number of parts can be reduced, and this can reduce the cost.

The supporting surface may be partially irradiated with the laser light. With this, quenched portions partially formed by the irradiation of the laser light become convex by heat expansion caused by transformation. Therefore, the quenched portions and non-quenched portions become projections and depressions. Therefore, a sliding property improves by an oil sump effect, and the seizing resistance further improves.

The supporting surface may be irradiated with the laser light in a stripe pattern such that quenched lines are formed to extend in a direction substantially perpendicular to the tilt direction of the swash plate. With this, when the swash plate is tilted and frictionally contacts (slides on) the supporting surface of the swash plate support while contacting the supporting surface, the quenched portions and non-quenched portions on the supporting surface provide multiple supports for the convex portion of the swash plate to disperse the surface pressure. Thus, the seizing resistance further improves.

A first swash plate type piston pump motor according to the present invention is a swash plate type piston pump motor in which: a plurality of pistons are arranged in a circumferential direction on a cylinder block configured to rotate with a rotating shaft; the pistons are guided along a swash plate to reciprocate by rotation of the rotating shaft; a convex portion of the swash plate is slidably supported by a recess of a swash plate support; and a wall formed integrally with the swash plate support is arranged on a normal to at least a part of a supporting surface of the recess, wherein the swash plate support is quenched by causing laser light to scan the supporting surface of the recess to irradiate the supporting surface of the recess with the laser light while changing an output of the laser light in accordance with an incidence angle of the laser light with respect to the supporting surface of the recess.

A second swash plate type piston pump motor according to the present invention is a swash plate type piston pump motor in which: a plurality of pistons are arranged in a circumferential direction on a cylinder block configured to rotate with a rotating shaft; the pistons are guided along a swash plate to reciprocate by rotation of the rotating shaft; a circular- convex portion of the swash plate is slidably supported by a circular-recess of a swash plate support; and a wall formed integrally with the swash plate support is arranged on a normal to at least a part of a supporting surface of the recess, wherein the swash plate support is quenched by causing laser light to scan the supporting surface of the recess to irradiate the supporting surface of the recess with the laser light while changing a scan speed of the laser light in accordance with an incidence angle of the laser light with respect to the supporting surface of the recess.

BEST MODE FOR CARRYING OUT THE INVENTION

Hereinafter, embodiments according to the present invention will be explained in reference to the drawings.

Embodiment 1

Figure 1:
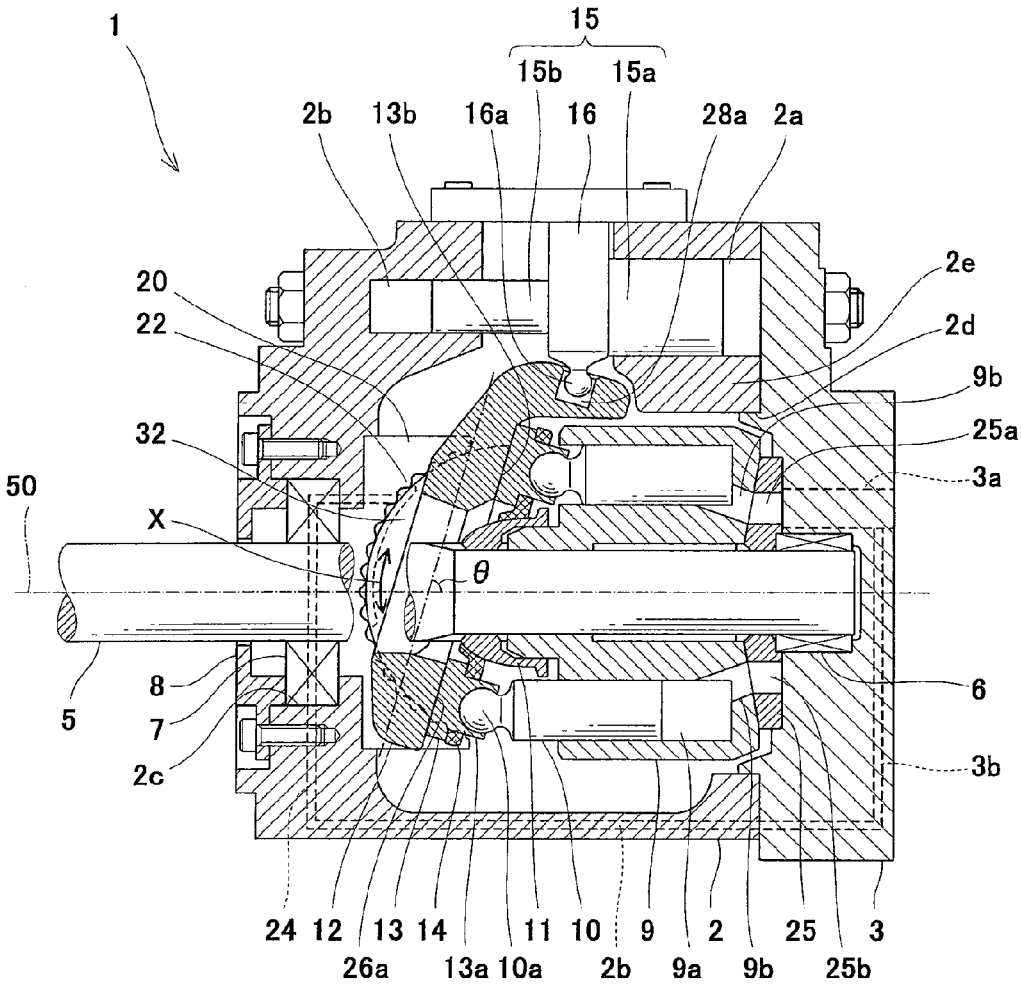
FIG. 1 is a cross-sectional view of a swash plate type piston pump motor according to an embodiment of the present invention.

FIG. 1 is a cross-sectional view of a swash plate type piston pump motor 1 according to an embodiment of the present invention. As shown in FIG. 1, the swash plate type piston pump motor 1 includes: a casing 2 with which a swash plate support 20 is formed integrally; and a valve cover 3 which closes a right opening of the casing 2 and has a discharging passage 3*a* and a sucking passage (not shown). A rotating shaft 5 rotatably supported by the casing 2 and the valve cover 3 via bearings 6 and 7 is disposed in the casing 2 so as to extend in a front-back direction (crosswise direction in FIG. 1), and a holding member 8 is attached outside the bearing 7 provided at a through hole 2*c* of the casing 2 from which the rotating shaft 5 projects.

A cylinder block 9 is splined to the rotating shaft 5, and rotates integrally with the rotating shaft 5. A plurality of piston chambers 9*a* are concavely formed on the cylinder block 9 so as to be equally spaced apart from one another in a circumferential direction about a rotating axis 50 of the rotating shaft 5. Each of the piston chambers 9*a* is formed to extend in parallel with the rotating axis 50, and stores a front end portion of each of pistons 10 which reciprocate. A rear end portion 10*a* of each piston 10 projecting from the piston chamber 9*a* is spherical, and is rotatably attached to a spherical bearing portion 13*a* of a shoe 13.

A receiving seat 11 of the shoe 13 externally fits a center rear end of the cylinder block 9. A swash plate 12 is disposed to face a contact surface 13*b* of the shoe 13 located opposite the spherical bearing portion 13*a* of the shoe 13 (located on a rear surface side of the shoe 13). The shoe 13 is pressed toward the swash plate 12 side by causing a pressing plate 14 to fit the shoe 13 from the cylinder block 9 side. The swash plate 12 includes a flat smooth surface 26*a* facing the contact surface 13*b* of the shoe 13. When the cylinder block 9 rotates, the shoe 13 is guided by and along the smooth surface 26*a* to rotate, and the pistons 10 reciprocate in a direction of the rotating axis 50. A convex portion 32 having a circular- friction surface 32*a* (see FIG. 4) is formed on a surface of the swash plate 12 located opposite the smooth surface 26*a* of the swash plate 12 (located on a rear surface side of the swash plate 12). The convex portion 32 is slidably supported by a circular- supporting surface 22*a* (see FIG. 3) of a recess 22 of the swash plate support 20.

A large-diameter cylinder chamber 2*a* and a small-diameter cylinder chamber 2*b* are coaxially formed at an upper portion of the casing 2 so as to be opposed to each other in the front-back direction (crosswise direction in FIG. 1). A large-diameter portion 15*a* of a tilt adjustment plunger 15 is stored in the large-diameter cylinder chamber 2*a*, and a small-diameter portion 15*b* of the tilt adjustment plunger 15 is stored in the small-diameter cylinder chamber 2*b*. A coupling member 16 is fixed to a central portion of the tilt adjustment plunger 15, and a lower end side spherical portion 16*a* of the coupling member 16 rotatably fits an upper recess 28*a* of the swash plate 12. Then, in a state where a normal pressure is applied to the small-diameter cylinder chamber 2*b*, a pressure supplied to the large-diameter cylinder portion 2*a* is increased or decreased by a regulator (not shown) to cause the tilt adjustment plunger 15 to slide in the crosswise direction. Thus, the friction surface 32*a* (see FIG. 4) of the convex portion 32 of the swash plate 12 slides on the supporting surface 22*a* (see FIG. 3) of the recess 22 of the swash plate support 20 in a tilt direction, and this changes a tilt angle θ of the swash plate 12 with respect to the rotating axis 50.

A valve plate 25 which slidably contacts the cylinder block 9 is attached to an inner surface side of the valve cover 3. The valve plate 25 includes an outlet port 25*a* and an inlet port 25*b*. An entrance 9*b* of the cylinder chamber 9*a* is communicated with the outlet port 25*a* or the inlet port 25*b* depending on a rotational phase of the cylinder block 9. The valve cover 3 includes: the discharging passage 3*a* which is communicated with the outlet port 25*a* of the valve plate 25 and opens on an outer surface of the valve cover 3; and the sucking passage (not shown) which is communicated with the inlet port 25*b* of the valve plate 25 and opens on the outer surface of the valve cover 3. The valve cover 3 further includes a bypass passage 3*b* branched from the discharging passage 3*a*. The bypass passage 3*b* is communicated with a relay passage 2*b* of the casing 2, and the relay passage 2*b* is communicated with a below-described oil supplying passage 24 through which the oil is supplied to the swash plate support 20.

Figure 2:
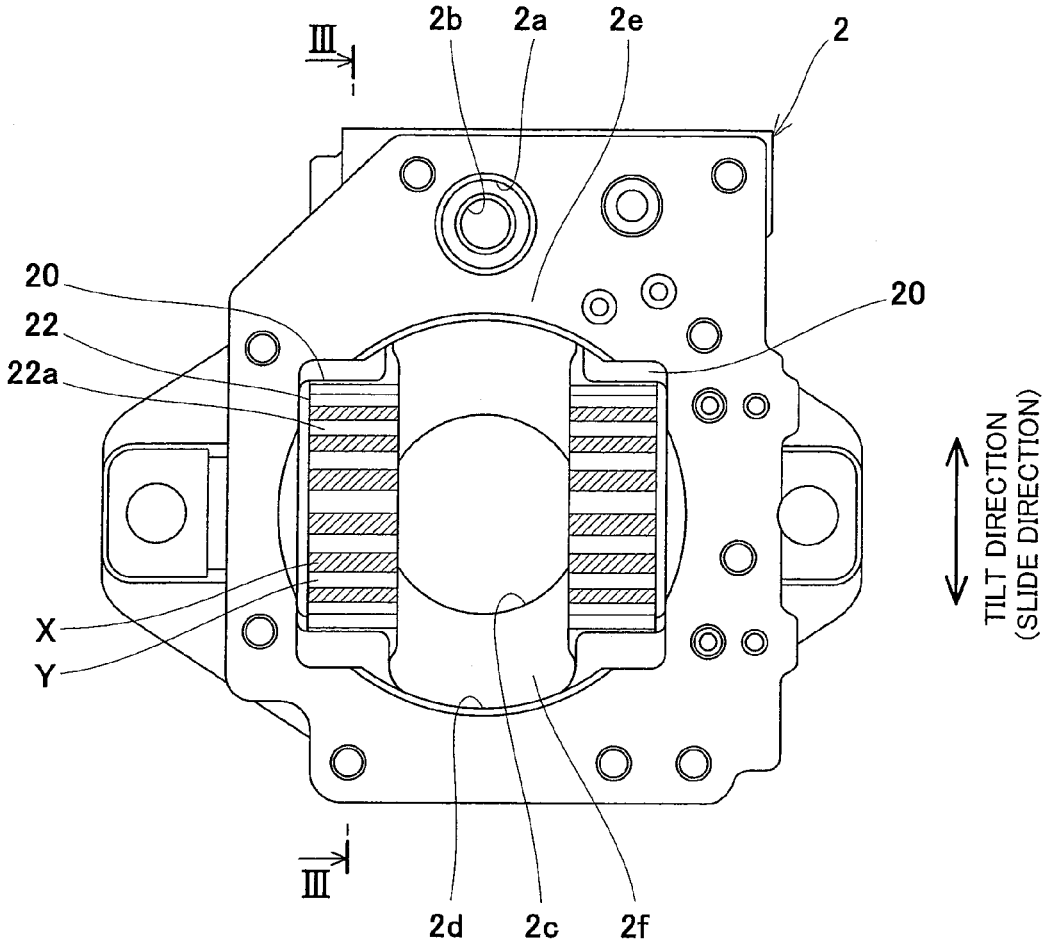
FIG. 2 is a front view of a casing of the swash plate type piston pump motor shown in FIG. 1.
Figure 3:
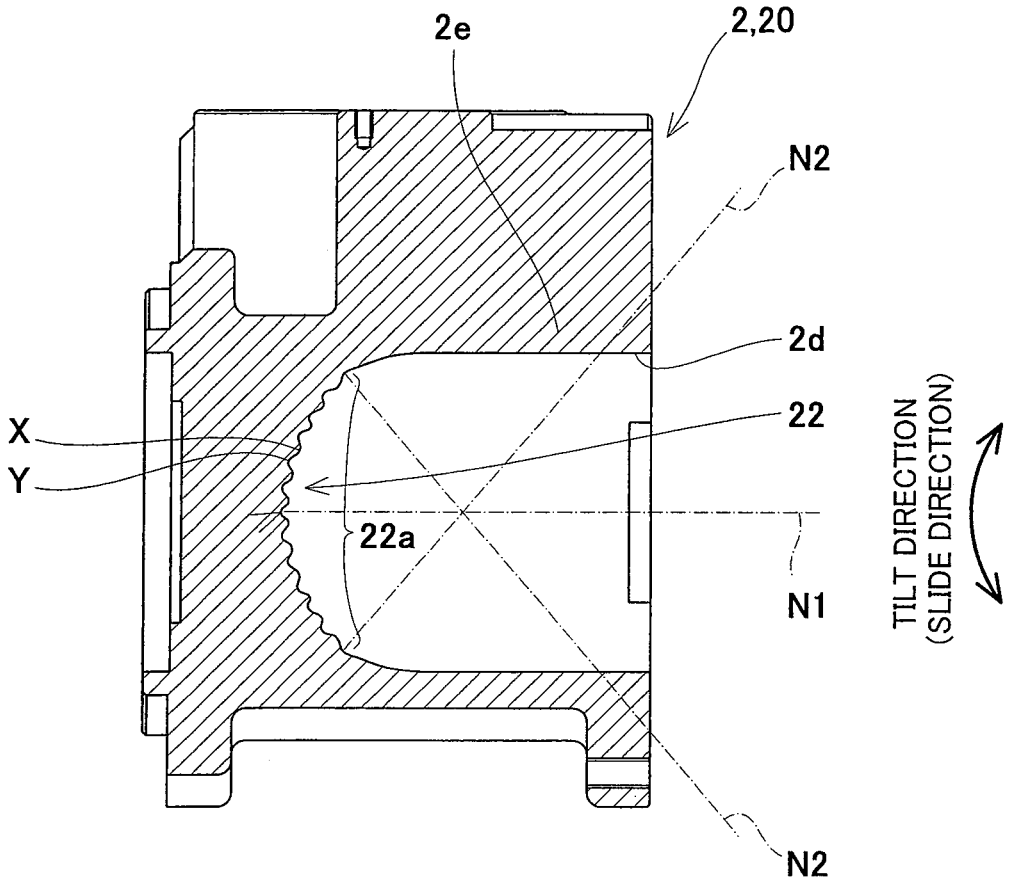
FIG. 3 is a cross-sectional view taken along line III-III of FIG. 2.

FIG. 2 is a front view of the casing of the swash plate type piston pump motor 1 shown in FIG. 1. FIG. 3 is a cross-sectional view taken along line III-III of FIG. 2. As shown in FIGS. 2 and 3, the casing 2 is made of cast iron for example, and includes: a tubular wall portion 2*e*; and a side wall portion 2*f* which closes an opening formed on one side (left side in FIG. 3) of the tubular wall portion 2*e*. An opening 2*d* is formed on the other side (right side in FIG. 3) of the tubular wall portion 2*e*. The through hole 2*c* through which the rotating shaft 5 (FIG. 1) penetrates is formed at the center of the side wall portion 2*f*. A pair of swash plate supports 20 are convexly provided at both sides (left and right sides in FIG. 2), respectively, of the through hole 2*c*.

The swash plate support 20 is provided with the recess 22 which is opposed to the swash plate 12. The recess 22 has the supporting surface 22*a* which slidably supports the convex portion 32 (FIG. 1) of the swash plate 12. The supporting surface 22*a* is opposed to the opening 2*d*, and is formed in a circular- shape which curves along the tilt direction of the swash plate 12. The opening 2*d* is located on a normal N1 to a center portion (deepest portion of the recess 22) of the supporting surface 22*a* with respect to the tilt direction, and the tubular wall portion 2*e* is located on a normal N2 to each of both end portions B (see FIG. 6) of the supporting surface 22*a* with respect to the tilt direction. The supporting surface 22*a* is irradiated with laser light in a stripe pattern by a laser irradiation device (FIG. 6), such as a carbon dioxide laser, a YAG laser, or a semiconductor laser, such that quenched lines X are formed to extend in a direction perpendicular to the tilt direction (slide direction) of the swash plate 12. Thus, stripe selective quenching is carried out such that hatching portions of FIG. 2 are formed. With this, the quenched lines X become slightly convex by expansion caused by structural transformation. Thus, the quenched lines X and non-quenched lines Y form minute projections and depressions. Moreover, the supporting surface 22*a* includes a pressure oil supply port (not shown) which is communicated with the oil supplying passage 24 of the casing 2, and the oil is supplied to the supporting surface 22*a* as lubricating oil.

Figure 4:
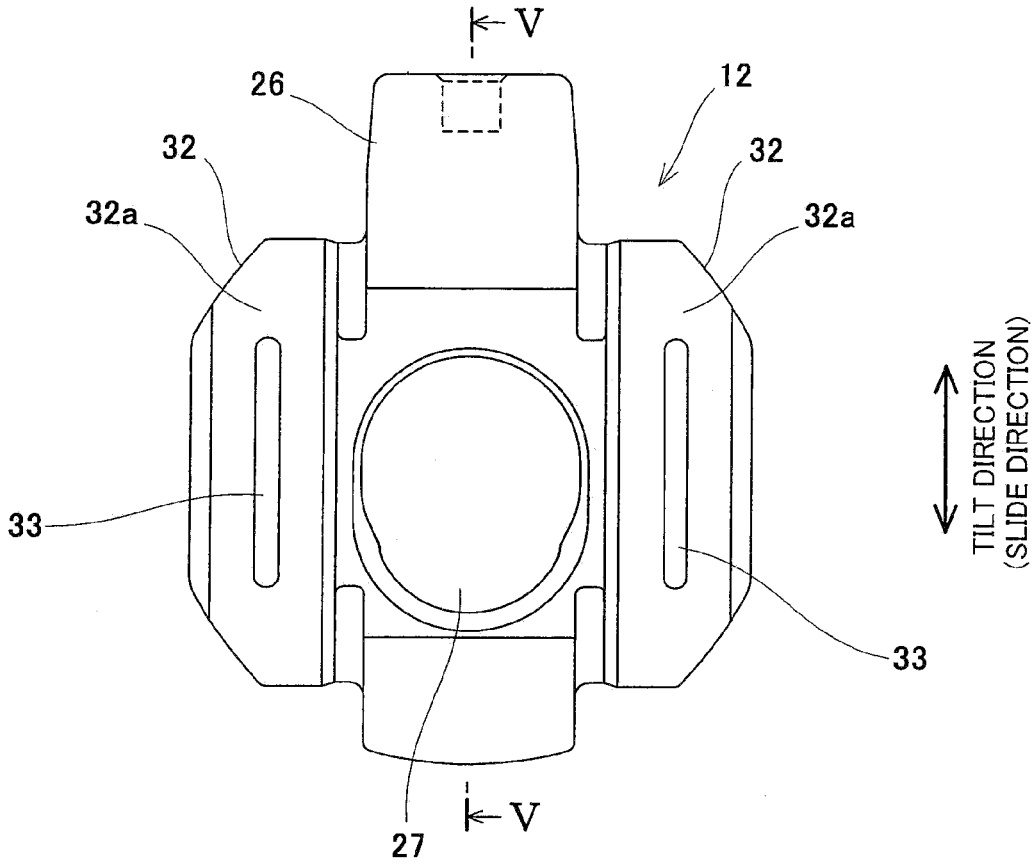
FIG. 4 is a rear view of a swash plate of the swash plate type piston pump motor shown in FIG. 1.
Figure 5:
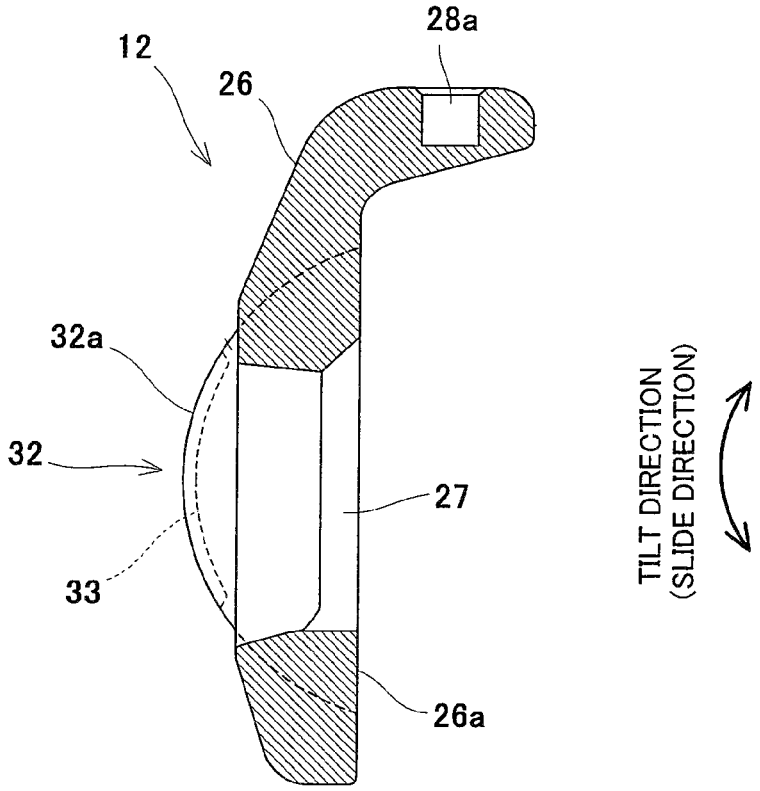
FIG. 5 is a cross-sectional view taken along line V-V of FIG. 4.

FIG. 4 is a rear view of the swash plate 12 of the swash plate type piston pump motor 1 shown in FIG. 1. FIG. 5 is a cross-sectional view taken along line V-V of FIG. 4. As shown in FIGS. 4 and 5, the swash plate 12 is made of cast iron which has been subjected to, for example, the gas nitrocarburizing for causing nitrogen to diffusively intrude into the cast iron to harden its surface. The swash plate 12 includes: a swash plate main body 26 having the smooth surface 26*a* which guides the shoe 13 (FIG. 1); and a pair of convex portions 32 formed on both sides (left and right sides in FIG. 4), respectively, of the swash plate main body 26 with respect to a width direction of the swash plate main body 26. A through hole 27 through which the rotating shaft 5 (FIG. 1) penetrates is formed at the center of the swash plate main body 26. The convex portion 32 includes the circular- smooth friction surface 32*a* opposed to the supporting surface 22*a* of the swash plate support 20. A groove portion 33 for holding an oil film is formed at a center portion of the friction surface 32*a* with respect to a width direction of the friction surface 32*a* so as to extend in the slide direction.

As shown in FIG. 1, in accordance with the operations of the swash plate type piston pump motor 1, the rotating shaft 5 is driven to rotate, and the cylinder block 9 rotates with the rotating shaft 5. Then, the piston 10 moving downward is guided by the swash plate 12 to be pulled out from the piston chamber 9*a*, so that the hydraulic oil is sucked into the piston chamber 9*a*, whereas the piston 10 moving upward is guided by the swash plate 12 to be pushed into the piston chamber 9*a*, so that the hydraulic oil in the piston chamber 9*a* is discharged. At this time, the convex portion 32 of the swash plate 12 is caused to slide along the supporting surface 22*a* of the recess 22 of the swash plate support 20 to adjust the tilt angle θ of the swash plate 12. Thus, the amount of stroke of the piston 10 is changed, so that the amount of oil discharged can be adjusted.

Figure 6:
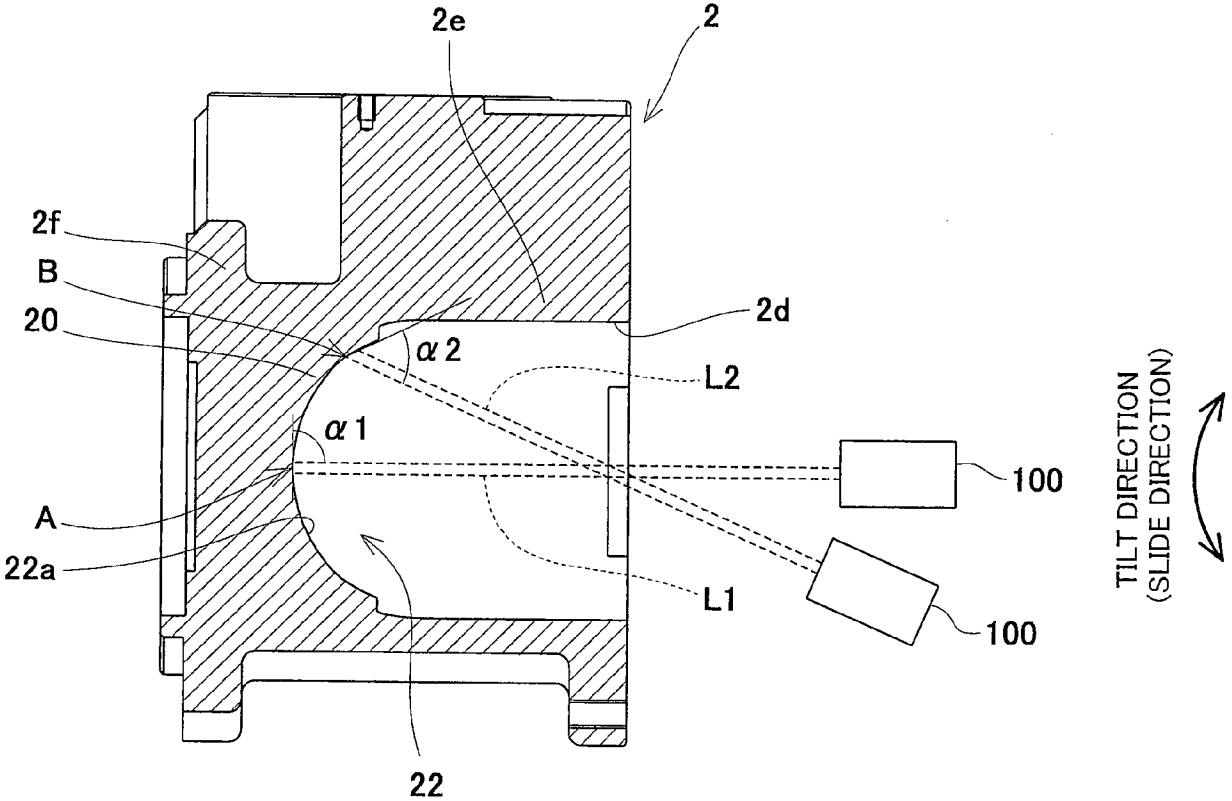
FIG. 6 is a diagram for explaining laser quenching carried out with respect to a swash plate support shown in FIG. 3.

Next, a method for quenching the supporting surface 22*a* of the recess 22 of the swash plate support 20 will be explained. FIG. 6 is a diagram for explaining the laser quenching with respect to the swash plate support 20 shown in FIG. 3. As shown in FIG. 6, the supporting surface 22*a* of the recess 22 of the swash plate support 20 is formed in a circular- shape which curves along the tilt direction of the swash plate 12. The tubular wall portion 2*e* of the casing 2 is located on the normal to each of both end portions B of the supporting surface 22*a* with respect to the tilt direction. To be specific, a center portion A of the supporting surface 22*a* can be irradiated with laser light L1 emitted from a laser irradiation device 100 through the opening 2*d* at a right angle (incidence angle α1=90 degrees). However, each of both end portions B of the supporting surface 22*a* cannot be irradiated with laser light L2 emitted from the laser irradiation device 100 at a right angle since the tubular wall portion 2*e* interrupts the laser light L2. Therefore, an incidence angle α2 of the laser light L2 with respect to each of both end portions B of the supporting surface 22*a* is set to be sharper, i.e., smaller than the incidence angle α1 of the laser light L1 with respect to the center portion A of the supporting surface 22*a*, and the outputs of the laser light L1 and L2 are changed depending on the incidence angles α1 and α2.

Specifically, the supporting surface 22*a* of the swash plate support 20 is irradiated with the laser light by the laser irradiation device 100, and the quenching is carried out in a stripe pattern while causing the laser light to scan the supporting surface 22*a* at a constant speed in a direction perpendicular to the plane of paper showing FIG. 6 such that the quenched lines X (see FIG. 2) are formed to extend in a direction substantially perpendicular to the tilt direction. At this time, as a laser irradiation region moves from the center portion A to each of both end portions B on the supporting surface 22*a*, the incidence angles α1 and α2 of the laser light L1 and L2 are decreased whereas the outputs of the laser light L1 and L2 are increased. To be specific, in order that the amount of laser light absorbed by the supporting surface 22*a* becomes substantially uniform along the tilt direction, the output of the laser light L2 with respect to each of both end portions B of the supporting surface 22*a* is set to be higher than the output of the laser light L 1 with respect to the center portion A of the supporting surface 22*a*. With this, a quenching depth is uniformized such that the seizing resistance and the abrasion resistance are surely given to the entire supporting surface 22*a*.

In accordance with the above explanation, the quenched lines X formed in a stripe pattern by utilizing the laser light become minute projections by the expansion caused by the structural transformation, so that the quenched lines X and the non-quenched lines Y form projections and depressions. Therefore, a sliding property improves and the seizing resistance increases by an oil sump effect and a surface pressure dispersion effect obtained by the multiple supports. At this time, since the quenched lines X are formed to extend in a direction perpendicular to the slide direction, the quenched line X and non-quenched line Y of the swash plate support 20 alternately face the friction surface 32*a* of the swash plate 12. Therefore, the surface pressure between the swash plate 12 and the swash plate support 20 is effectively distributed, so that the swash plate 12 and the swash plate support 20 tend to smoothly contact each other. Thus, the seizing resistance improves. In addition, since the minute convex quenched lines X contacting the friction surface 32*a* of the swash plate 12 are quenched and hardened by the structural transformation, the abrasion resistance also improves.

In addition, only the supporting surface 22*a* of the swash plate support 20 may be quenched by the laser light. Therefore, the seizing resistance and the abrasion resistance can be cleanly given to the supporting surface 22*a* by small-scale equipment in a short period of time. Further, since this quenching is selective quenching whose case depth is shallow, the heat deformation is less likely to occur, so that finishing processing can be omitted. Moreover, the laser quenching can be carried out in the atmosphere, and does not require cooling fluid. Further, a quenched surface only has to have a certain absorption ratio of the laser light. Therefore, a high-quality surface treatment can be realized without paying too much attention to cleanliness of surfaces of parts as in the case of the gas nitrocarburizing. On this account, inline processing can be carried out in a production line of the piston pump motor. Thus, the productivity and the quality can be improved. Moreover, since the swash plate support 20 is formed integrally with the casing 2, the number of parts can be reduced, and this can reduce the cost.

Further, in the step of quenching the supporting surface 22*a* of the swash plate support 20, as the laser irradiation region moves from the center portion A to each of both end portions B on the supporting surface 22*a*, the incidence angles α1 and α2 of the laser light L1 and L2 are decreased, and the outputs of the laser light L1 and L2 are increased. Therefore, even though the tubular wall portion 2*e* of the casing 2 is located on the normal to the supporting surface 22*a*, the amount of laser light absorbed by the supporting surface 22*a* can be uniformized along the tilt direction. On this account, the seizing resistance and the abrasion resistance can be uniformly given to the entire supporting surface 22*a*.

The present embodiment has explained the operation of a swash plate type piston pump in which a rotational driving force of the rotating shaft 5 is an input and sucking/discharging of the hydraulic oil by the piston 10 is an output. However, the present embodiment may be used as a swash plate type piston motor in which inflowing/outflowing of the pressure oil to/from the cylinder chamber 9*a* is an input and the rotation of the rotating shaft 5 is an output.

Embodiment 2

Next, Embodiment 2 will be explained. Embodiment 2 is different from Embodiment 1 in that when carrying out the quenching, the scan speed of the laser light is changed instead of changing the output of the laser light. The configuration of the swash plate type piston pump motor in Embodiment 2 is the same as that in Embodiment 1. Hereinafter, Embodiment 2 will be explained mainly in reference to FIG. 6 again.

The supporting surface 22*a* of the swash plate support 20 is irradiated with the laser light by the laser irradiation device 100, and the quenching is carried out in a stripe pattern while maintaining the output of the laser light at a constant state and causing the laser light to scan the supporting surface 22*a* in a direction perpendicular to the plane of paper showing FIG. 6 such that the quenched lines X (FIG. 2) are formed to extend in a direction substantially perpendicular to the tilt direction. At this time, as the laser irradiation region moves from the center portion A to each of both end portions B on the supporting surface 22*a*, the incidence angles α1 and α2 of the laser light L1 and L2 are decreased, and the scan speeds of the laser light L1 and L2 are also decreased. To be specific, in order that the amount of laser light absorbed by the supporting surface 22*a* becomes substantially uniform along the tilt direction, the scan speed of the laser light L2 with respect to each of both end portions B of the supporting surface 22*a* is set to be lower than the scan speed of the laser light L1 with respect to the center portion A of the supporting surface 22*a*. With this, the quenching depth is uniformized such that the seizing resistance and the abrasion resistance are surely given to the entire supporting surface 22*a*. The other configurations and actions in Embodiment 2 are the same as those in Embodiment 1, so that explanations thereof are omitted.

EXPERIMENTAL EXAMPLE

Figure 7:
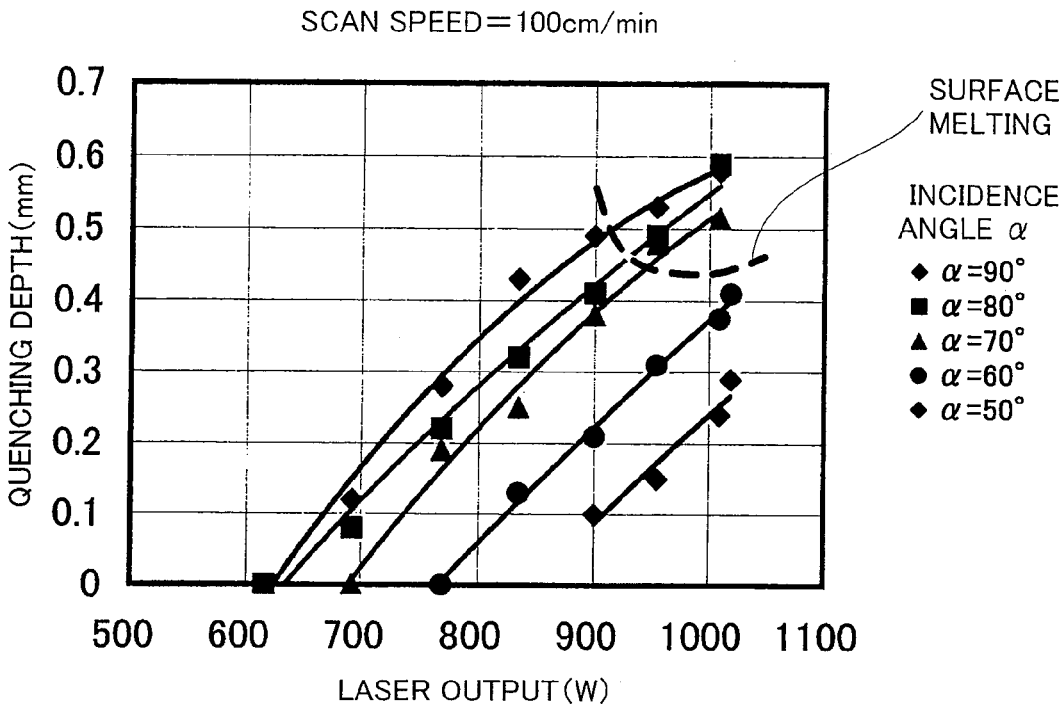
FIG. 7 is a graph showing a relation between a laser output and a quenching depth when a scan speed V is 100 cm/min.
Figure 8:
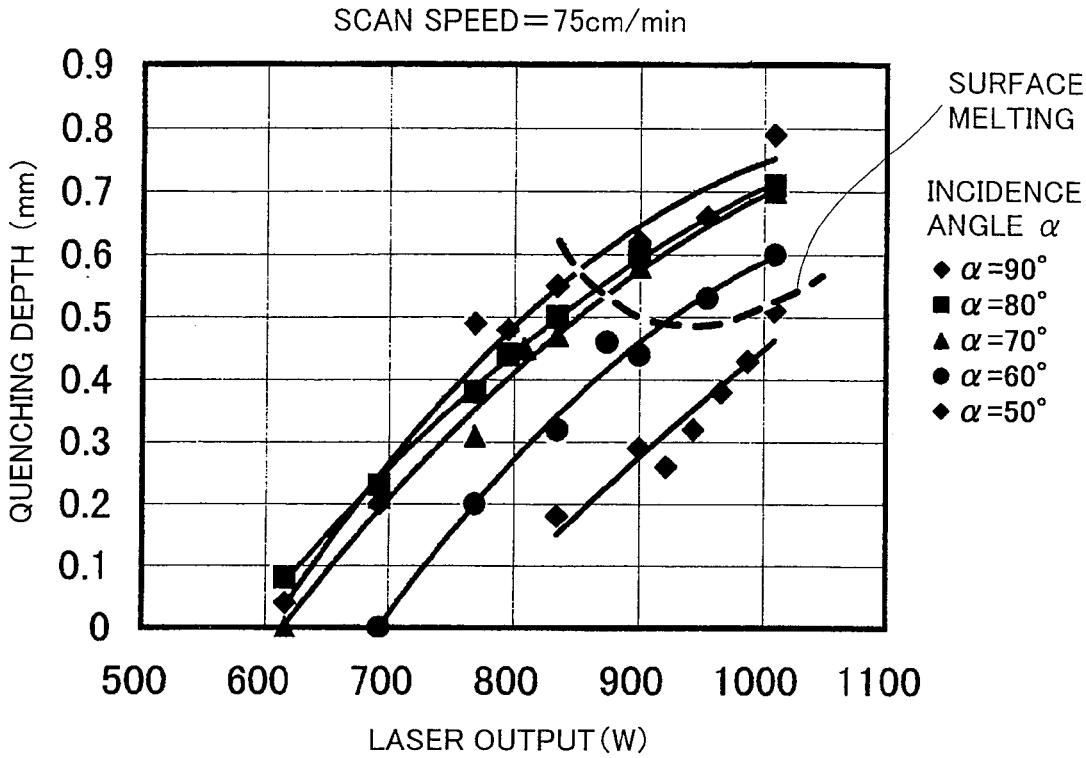
FIG. 8 is a graph showing a relation between the laser output and the quenching depth when the scan speed V is 75 cm/min.
Figure 9:
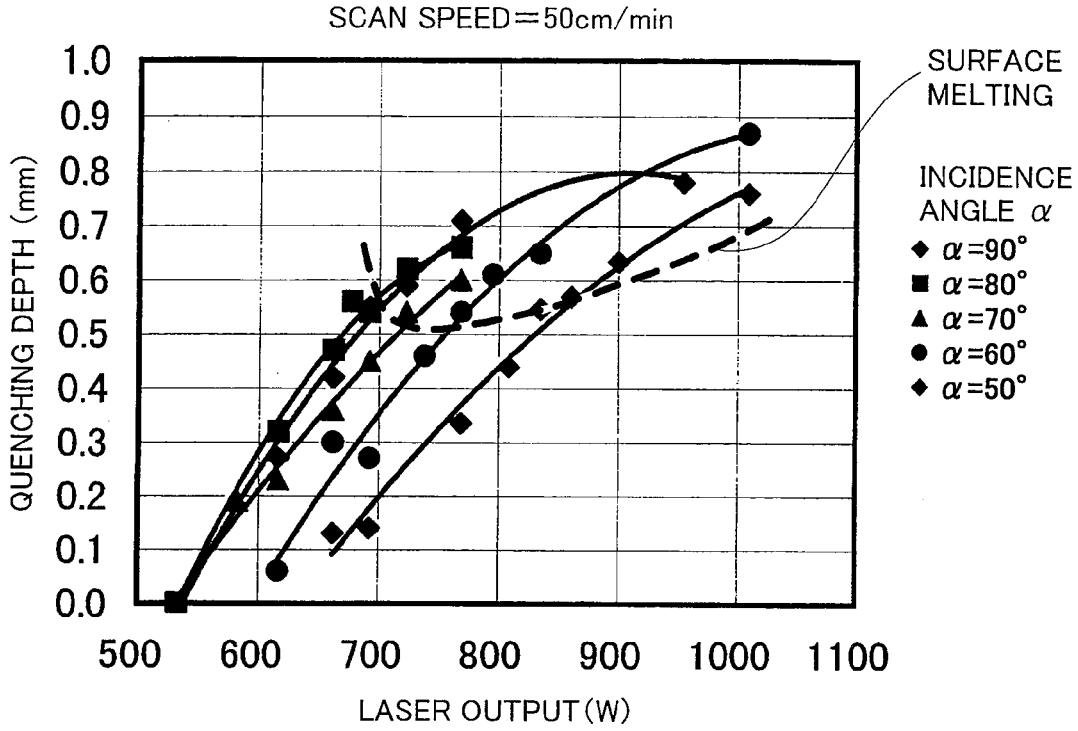
FIG. 9 is a graph showing a relation between the laser output and the quenching depth when the scan speed V is 50 cm/min.

Next, an Experimental Example will be explained. FIG. 7 is a graph showing a relation between the laser output and the quenching depth when the scan speed V is 100 cm/min. FIG. 8 is a graph showing a relation between the laser output and the quenching depth when the scan speed V is 75 cm/min. FIG. 9 is a graph showing a relation between the laser output and the quenching depth when the scan speed V is 50 cm/min. FIGS. 7 to 9 show the relation between the quenching depth and the irradiation condition (incidence angle, scan speed, laser output) in a case where the laser quenching is carried out with respect to a test plate made of the same material as the swash plate support 20 under various laser irradiation conditions in order to determine the laser irradiation condition in the production line. The material of the test plate is cast iron (FC300), and the width of the quenched line is about 3 mm.

As can be seen from the graphs of FIGS. 7 to 9, in a case where the scan speed of the laser light is constant, the quenching depth decreases by decreasing the incidence angle, and the quenching depth increases by increasing the laser output. This is because the amount of laser light absorbed by the test plate increases by increasing the laser output, and the amount of laser light absorbed by the test plate decreases by decreasing the incidence angle. Therefore, as explained in Embodiment 1 for example, in order to uniformize the quenching depth while changing the incidence angle in a case where the scan speed of the laser light is constant, the laser output may be adjusted to be increased in accordance with the decrease in the incidence angle.

In addition, as can be seen from FIGS. 7 to 9, the quenching depth increases by decreasing the scan speed of the laser light. This is because the amount of laser light absorbed by the test plate increases by decreasing the scan speed of the laser light. Here, a region located on an upper right side of a boundary shown by a dotted line in each of the graphs of FIGS. 7 to 9 denotes a region where the surface of the test plate is melted since the intensity of the laser light is too high. Therefore, the upper limit of the appropriate quenching depth is set to 0.45 mm or less which does not cause the melting of the surface. In contrast, if the quenching depth is too shallow, the seizing resistance and the abrasion resistance may become inadequate. Therefore, the lower limit of the appropriate quenching depth is set to 0.25 mm or more.

Figure 10:
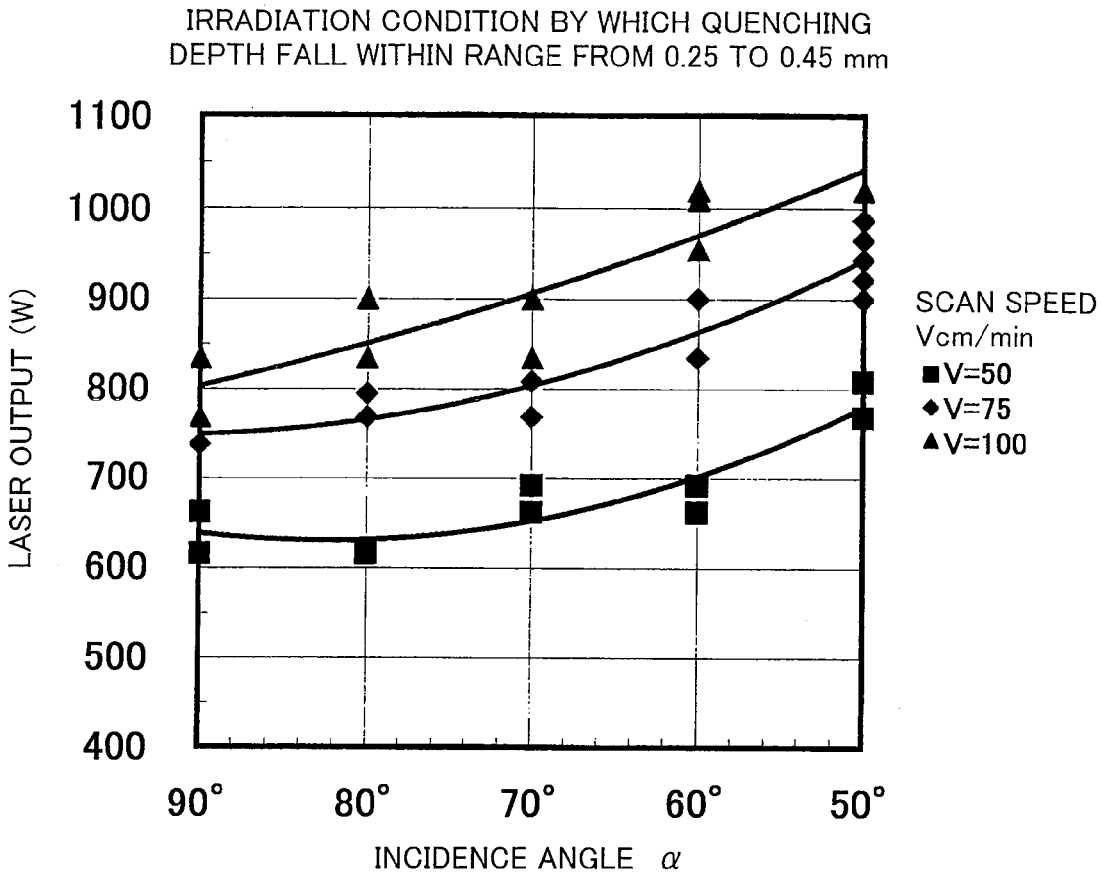
FIG. 10 shows that an irradiation condition from which an appropriate quenching state can be obtained is picked up from each of FIGS. 7 to 9, and is a graph showing a relation between an irradiation angle and the laser output at each scan speed.

FIG. 10 shows that an irradiation condition from which an appropriate quenching state can be obtained is picked up from each of FIGS. 7 to 9, and is a graph showing a relation between an irradiation angle and the laser output at each scan speed. FIG. 10 shows an appropriate irradiation condition by which the quenching depth falls within a range from 0.25 to 0.45 mm. As explained in Embodiment 2 for example, in order to uniformize the quenching depth within a certain range while changing the incidence angle in a case where the laser output is constant, the scan speed of the laser light may be adjusted to be decreased in accordance with the decrease in the incidence angle.

Figure 11:
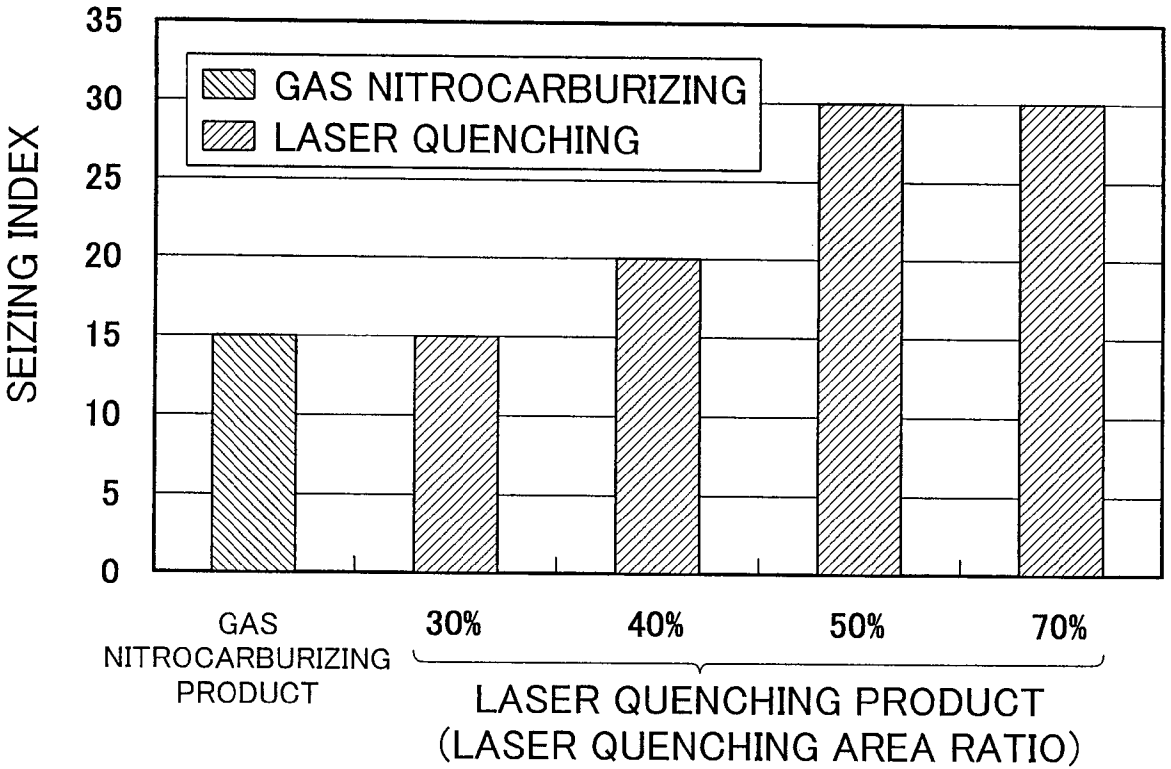
FIG. 11 is a graph showing results of a seizing resistance comparative test of the swash plate support subjected to the laser quenching.

FIG. 11 is a graph showing results of a seizing resistance comparative test of the swash plate support subjected to the laser quenching. As shown in FIG. 11, if 40% or more of the area of the circular- surface of a laser quenching product is quenched, the seizing resistance of the laser quenching product becomes better than that of a gas nitrocarburizing product. It is especially preferable that the percentage of the quenched area be 50 to 70%.

The invention claimed is:

1. A method for manufacturing a swash plate type piston pump motor in which: a plurality of pistons are arranged in a circumferential direction on a cylinder block configured to rotate with a rotating shaft; the pistons are guided along a swash plate to reciprocate by rotation of the rotating shaft; a convex portion of the swash plate is slidably supported by a recess of a swash plate support; and a wall formed integrally with the swash plate support is arranged on a normal to at least a part of a supporting surface of the recess, wherein:

the supporting surface of the recess of the swash plate support is quenched by irradiating the supporting surface with laser light while causing the laser light to scan the supporting surface;

an output of the laser light is changed in accordance with an incidence angle of the laser light with respect to the supporting surface;

a material of the supporting surface is cast iron;

a depth of the quenching is set in a range from 0.25 to 0.45 mm;

an area of a quenched portion of the supporting surface is set to 50 to 70% of an area of the supporting surface by partially irradiating the supporting surface with the laser light; and by irradiating the supporting surface with the laser light in a stripe pattern such that quenched lines are formed to extend in a direction substantially perpendicular to a tilt direction of the swash plate, the quenched lines and non-quenched lines form projections and depressions.

2. The method according to claim 1, wherein:

the supporting surface is formed in a circular- shape which curves along the tilt direction of the swash plate;

the wall is arranged on a normal to each of both end portions of the supporting surface with respect to the tilt direction, and an opening is formed on a normal to a center portion of the supporting surface with respect to the tilt direction;

the incidence angle of the laser light with respect to each of the end portions of the supporting surface is smaller than the incidence angle of the laser light with respect to the center portion of the supporting surface; and an output of the laser light with respect to each of the end portions of the supporting surface is higher than an output of the laser light with respect to the center portion of the supporting surface.

3. The method according to claim 1, wherein:

the swash plate support is formed integrally with a casing; and the wall is the casing.

4. A method for manufacturing a swash plate type piston pump motor in which: a plurality of pistons are arranged in a circumferential direction on a cylinder block configured to rotate with a rotating shaft; the pistons are guided along a swash plate to reciprocate by rotation of the rotating shaft; a circular- convex portion of the swash plate is slidably supported by a circular- recess of a swash plate support;

and a wall formed integrally with the swash plate support is arranged on a normal to at least a part of a supporting surface of the recess, wherein:

the supporting surface of the recess of the swash plate support is quenched by causing laser light to scan the supporting surface;

a scan speed of the laser light is changed in accordance with an incidence angle of the laser light with respect to the supporting surface;

a material of the supporting surface is cast iron;

a depth of the quenching is set in a range from 0.25 to 0.45 mm;

an area of a quenched portion of the supporting surface is set to 50 to 70% of an area of the supporting surface by partially irradiating the supporting surface with the laser light; and by irradiating the supporting surface with the laser light in a stripe pattern such that quenched lines are formed to extend in a direction substantially perpendicular to a tilt direction of the swash plate, the quenched lines and non-quenched lines form projections and depressions.

5. The method according to claim 4, wherein:

the supporting surface is formed in a circular- shape which curves along the tilt direction of the swash plate;

the wall is arranged on a normal to each of both end portions of the supporting surface with respect to the tilt direction, and an opening is formed on a normal to a center portion of the supporting surface with respect to the tilt direction;

the incidence angle of the laser light with respect to each of the end portions of the supporting surface is smaller than the incidence angle of the laser light with respect to the center portion of the supporting surface; and a scan speed of the laser light with respect to each of the end portions of the supporting surface is lower than a scan speed of the laser light with respect to the center portion of the supporting surface.

* * * * *

UNITED STATES PATENT AND TRADEMARK OFFICE

CERTIFICATE OF CORRECTION

PATENT NO. : 8,425,699 B2
APPLICATION NO. : 12/593595
DATED : April 23, 2013
INVENTOR(S) : Mori et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 546 days.

Signed and Sealed this
Eighth Day of September, 2015

Michelle K. Lee

Michelle K. Lee
*Director of the United States Patent and Trademark Office*